United States Patent [19]

DeWitte

[11] Patent Number: 4,954,183

[45] Date of Patent: Sep. 4, 1990

[54] LEAD HEAT TREATMENT OF WIRE WITH PREVENTION OF LEAD ENTRAINMENT

[75] Inventor: Marc DeWitte, Moen, Belgium

[73] Assignee: N.V. Bekaert S.A., Zwevegem, Belgium

[21] Appl. No.: 327,086

[22] Filed: Mar. 22, 1989

[30] Foreign Application Priority Data

Apr. 25, 1988 [EP] European Pat. Off. ..... 88200789.1

[51] Int. Cl.[5] ..... C21D 1/48; C21D 9/58; C23C 2/18; C23C 2/20

[52] U.S. Cl. ..... 148/15; 148/18; 148/156; 427/405; 134/9; 134/15

[58] Field of Search ..... 148/15, 18, 156; 427/405; 134/9, 15

[56] References Cited

U.S. PATENT DOCUMENTS

| | | | |
|---|---|---|---|
| 1,545,305 | 7/1925 | Crapo et al. | 148/15.5 |
| 2,286,745 | 6/1942 | Liebhafsky | 148/13.2 |
| 4,062,703 | 12/1977 | Vastag | 148/26 |
| 4,228,200 | 10/1980 | Sander et al. | 427/47 |

FOREIGN PATENT DOCUMENTS

| | | | |
|---|---|---|---|
| 653783 | 11/1937 | Fed. Rep. of Germany . | |
| 3713401 | 3/1988 | Fed. Rep. of Germany . | |
| 55-085662 | 6/1980 | Japan | 148/156 |

*Primary Examiner*—R. Dean
*Assistant Examiner*—Margery S. Phipps
*Attorney, Agent, or Firm*—Foley & Lardner, Schwartz, Jeffery, Schwaab, Mack, Blumenthal & Evans

[57] ABSTRACT

Drag out of lead with elongated steel elements (1) upon exit from a bath (2) of molten lead is prevented by bringing the elongated steel elements into contact with an amount of a substance such as $H_2S$, Hcl or $ZnCl_2/.nNH_4Cl$, that is capable of transforming lead oxide into another product at the exit conditions of said elongated steel elements (1) from the bath (2) of molten lead. The steel may emerge from the bath into a non-oxidizing atmosphere, such as a bed of coal, where the converted lead or lead compound may be mechanically stripped from the element.

11 Claims, 2 Drawing Sheets

LEAD HEAT TREATMENT OF WIRE WITH PREVENTION OF LEAD ENTRAINMENT

The invention relates to a process of heat treatment of at least one elongated steel element and more specifically to a process of preventing the drag-out of lead with said elongated steel element upon exit from a bath of molten lead.

By an elongated steel element is meant a steel element the longitudinal dimensions of which are more than hundred times the dimensions of the cross-section. Steel wires with circular and rectangular cross-section are examples of elongated steel elements but don'limit the scope of the present invention.

Said elongated steel elements are often subjected to heat treatments. Their object is to alter the mechanical properties of the elongated steel elements. Examples of those heat treatments are

- annealing of low-carbon (0–0.2% C) steel wire at a temperature of 700°–75O° C.;
- stress-relieving of low-carbon (0–0.2% C) steel wire at a temperature of 500°–600° C.;
- patenting of high-carbon (0.2–1.0% C) steel wire, i.e. austenitizing in a furnace at 900°–1200° C. and quenching at 550°–65O° C.

These heat treatments are conveniently in line with other preceding and following treatments of the elongated steel elements such as degreasing, rinsing, pickling, bonderizing, hot dip and electroplating, galvanizing, drawing, ...

For these heat treatments lead has proved to be an advantageous medium in a temperature range of 500 to 75O° C. thanks to its qualities of excellent heat transfer.

However, the use of lead baths presents serious drawbacks. One of the main drawbacks is the drag out of lead with the elongated steel elements once they emerge from the bath of molten lead. This gives rise to a number of great problems :

- loss of tons of lead;
- hygienic and environmental problems;
- negative influence on the further process steps such as poisoning of subsequent baths, difficulties in wire drawing, increased sensibility to corrosion : poor adherence between substrate and coating, loss of rubber adhesion in cases where the elongated steel element is intended to be used for rubber reinforcement.

The greater the linear velocity of the elongated steel element, the greater the drag out of lead. This considerably reduces the practical velocity of the elongated steel element through the bath of molten lead and, as a consequence, also the velocity of the elongated steel element for the other treatments that are in line with the bath of molten lead. It is needless to state that this phenomenon affects productivity and manufacturing costs.

The drag out of lead is a complex phenomenon where a great number of parameters play an important part. The condition and roughness of the surface of the elongated steel element, the number and kind of vibrations, the angle of exit at which the elongated steel element is conducted through the bath of molten lead . . . all influence the amount of lead that is dragged with the elongated steel element.

Apart from looking for substantially different methods that avoid the use of lead baths such as the use of fluidized beds, induction heating and water patenting, the prior art provides several solutions for the reduction of the drag out of lead.

In U.S. Patent specification No. 2,531,132 (1949) the elongated steel element is forced to pass through a sand pan when leaving the bath of molten lead. The accumulation or solidification of lead within the sand pan is prevented by bodily shifting the elongated steel element when passing through the sand pan.

According to U.S. Pat. Specification No. 3,669,761 (1972) it had been known to cover the surface of the bath of molten lead where the elongated steel elements emerge with a non-inflammable granular material such as gravel or sand or with charcoal or coke of suitable grain size. The purpose of this covering is to prevent the surface of the lead bath from being oxidized as well as to strip the lead from the emerging elongated steel elements. Still according to U.S. Pat. specification No. 3,669,761 (1972) none of these measures gave satisfactory results. The patent specification then provides as an adequate solution a slotted plate freely floating on the surface of the bath of molten lead at the point of emergence of the elongated steel elements. The top surface of the plate is covered with granulated amorphous carbon and the elongated steel elements are forced to pass through the slotted portions of the plate.

These prior art solutions don' give satisfactory results when working at high linear velocities of the elongated steel element It is an object of the present invention to decrease the drag out of lead with elongated steel elements.

It is another object of the present invention to increase the velocity of conducting the elongated steel elements through a bath of molten lead.

It is still another object of the present invention to facilitate the subsequent treatments of the elongated steel elements and to reduce the lead poisoning of the environment.

According to the invention there is provided a process of heat treatment of at least one elongated steel element comprising a step of conducting said elongated steel element through a bath of molten lead, characterized in that upon exit from said bath of molten lead said elongated steel element is brought into contact with an amount of a substance that is capable of transforming lead oxide at the exit conditions of said elongated steel element from said bath of molten lead.

The inventor has discovered that the lead drops that are entrained with the elongated steel elements are enveloped by a small strong film. This small strong film appeared to be lead oxide in spite of the use of a charcoal bed at the exit of the bath of molten lead. Formation of lead oxide on the surface of the bath of molten lead and the surface of the lead that i dragged with the emerging elongated steel elements has appeared to be impossible to avoid. This is due to the presence of occluded oxygen in the bath of molten lead and also to the oxidation of lead at the exit of the lead bath due to oxygen in the environment. And it is very difficult, if not impossible, to remove the lead oxide and the enveloped lead drops by pure mechanical means such as suggested by the prior art.

By "a substance that is capable of transforming lead oxide at the exit conditions of said elongated steel element from said bath of molten lead" is meant a substance that is thermodynamically and kinetically suitable to transform lead oxide into another more stable lead compound, that is leess viscous than lead oxide or that is capable of reducing lead oxide into lead, and this at a temperature between 350° and 800° C. and at a linear speed of the elongated steel elements that is greater than 50 m/min. Suitable substances may be found in the group of the sulfides, fluorides, iodides, bromides and chlorides. However, a lot of these products are very poisonous so that a very good exhaust system must be provided.

The exact value of the "amount" of this substance depends on the kind and the form (a gas, a liquid . . .) of the substance. Anyway, an "amount" does not mean traces.

In a preferable embodiment of the invention the substance is ammonium chloride $NH_4Cl$. At temperatures which are convenient at the exit of a bath of molten lead this ammonium chloride dissociates according to the reaction:

$$NH^4Cl \rightarrow NH_3 + HCl \quad (I)$$

The ammonium evaporates and may be exhausted. The formed hydrogen chloride is the so-called nascent hydrogen chloride that is very reactive at these temperatures. It reacts with the lead oxide according to the reaction:

$$PbO + 2\ HCl43\ PbCl_2 + H_2O \quad (II)$$

Chemical reaction (II) does not mean that HCl is suitable for transforming only the lead oxide PbO. The other lead oxides $PbO_x$ may also be transformed by HCl.

However, ammonium chloride is not a stable product at these temperatures. This is the reason why in another preferable embodiment of the invention ammonium chloride may be "replaced" by the "double salts"

$$ZnCl_2.n\ NH_4Cl$$

where n is an integer greater than or equal to one and smaller than or equal to three. The value of n determines the ratio of ammonium chloride molecules to zinc chloride molecules , e.g. if n equals two then there are two molecules of ammonium chloride for each molecule of zinc chloride.

In a more general sense other suitable substances according to the present invention are substances that are capable of dissociating a molecule in the exit conditions of the bath of molten lead, this molecule being unstable in the presence of lead oxide in said exit conditions of the bath of molten lead.

In addition to the use of $ZnCl_2.nNH_4Cl$ the exit of the bath of molten lead is most preferably a non-oxidizing atmosphere. This may be accomplished by covering the exit of the bath of molten lead with a bed of coal, e.g. anthracite coal or with a bed f gravel or some other granular material. This bed both prevents the oxidation to some extent and strips the lead from the elongated steel elements in a mechanical way once the film of lead oxide has been totally or partly transformed.

Other mechanical means such as disclosed in the prior art may be provided to strip the lead from the emerging elongated steel elements.

The invention will now be described with reference to the accompanying drawings wherein FIG. 1 represents a global view of an embodiment of the invention;

Figure 1:
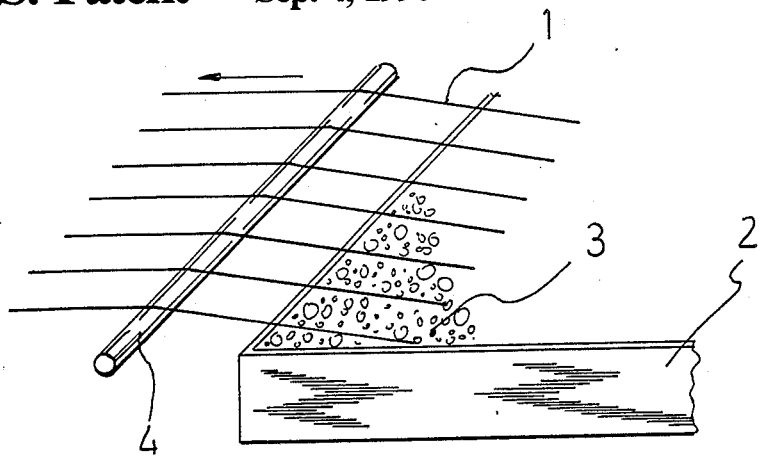

FIG. 1 shows one embodiment of the invention. The elongated steel elements 1 emerge from the bath of molten lead 2 and pass through a bed of coal 3 over a supporting bar or roller 4 to the subsequent treatments. The product that transforms the lead oxide is a solid product, e.g. $ZnCl_2$ $NH_4Cl$ and is mixed with the coal with a weight ratio $ZnCl_2.NH_4Cl$ - coal which lies between 0.02 and 0.4, e.g. 0.1 or 0.2. The ammonium chloride part of this solid product dissociates into ammonium and hydrogen chloride according to the above mentioned reaction (1). The formed ammonium evaporates and the hydrogen chloride reacts with lead oxide and forms lead chloride according to the above mentioned reaction (II). The zinc chloride and the lead chloride stay in the bed of coal 3. The bed of coal 3 easily strips the remaining lead (which is less viscous than lead oxide) from the steel wires. Thanks to its small viscosity lead easily flows back through the bed of coal 3 to the lead bath 2. The zinc chloride and the lead chloride may saturate the bed of coal 3 after a period of time which necessitates periodical renewal of the bed of coal 3.

Figure 2:
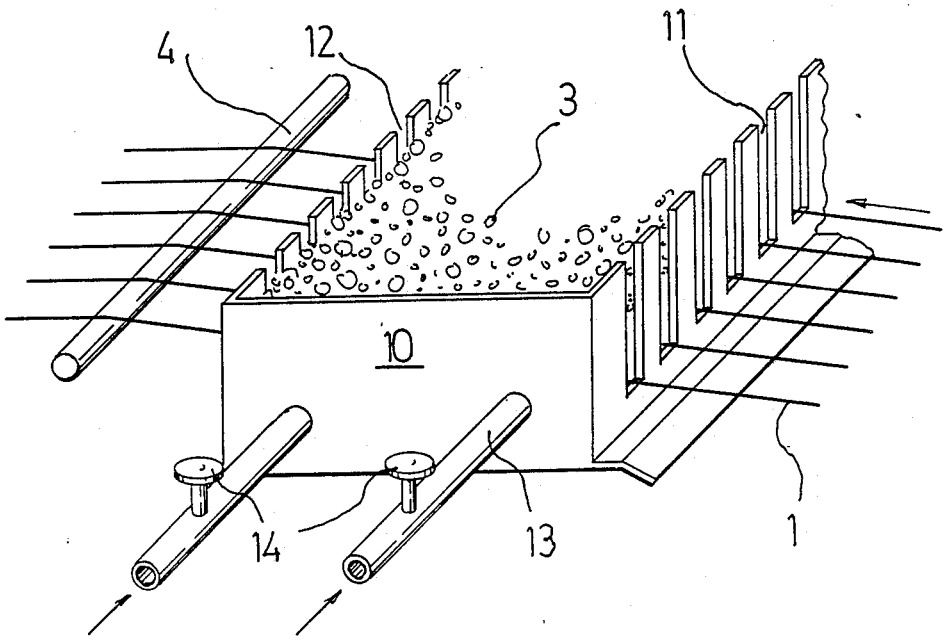
FIG. 2 represents a global view of another embodiment of the invention.

FIG. 2 shows another embodiment of the invention. The elongated steel elements 1 emerge from the bath of molten lead and pass through a slot 11 into a metal box 10 that is filled with coal 3. The elongated steel elements leave the metal box 10 through an opposite slot 12 and pass over a supporting bar or roller 4 to the subsequent treatments. The product that transforms the lead oxide is a gaseous product, e.g. $H_2S$. $H_2S$ is conducted (together with a carrier gas) through one or more tubes 13 to the metal box 10. A valve 14 regulates the flow of $H_2S$. An exhaust system may be installed above the metal box 10 (not shown on the figure).

TEST 1

A first test has been carried out on twenty low carbon steel wires which are conducted at a linear velocity of 100 m/min through a bath of molten lead. The temperature of the lead bath is 75O° C. (annealing treatment). During a first week no product susceptible of transforming lead oxide has been added to a bed of anthracite coal at the exit of the lead bath. During a second week a metal box 10 according to FIG. 2 has been installed and dimethyl disulfide (DMDS=$CH_3$-S-S-$CH_3$) has been fed into the metal box 10. Finally, for a third week the metal box 10 has been removed and the bed of anthracite has been mixed with $ZnCl_2$. $NH_4Cl$. Table 1 summarizes the visual aspects noticed after the resp. weeks.

TABLE 1

| | visual aspects | |
|---|---|---|
| after week | at the end of the bed of anthracite coal(3) | on the supporting bar(4) |
| 1 | a lot of solidified lead + lead oxide (green-yellow colour) | a lot of solidified lead + lead oxide (green-yellow colour) |
| 2 | less solidified lead + less lead oxide | less solidified lead + less lead oxide |
| 3 | no solidified lead + no green-yellow colour | no solidified lead + no green-yellow colour |

As can be derived from table 1 DMDS improves the situation but $ZnCl_2$. $NH_4HCl$ provides the best solution : at least visually, no lead is entrained anymore.

TEST 2

A second test illustrates a decrease in the poisoning of a subsequent bath when the teaching of the invention is applied.

In a galvanizing installation the different wires are first annealed (750° C.) in a lead bath and are further coated with zinc in a zinc bath. The lead contamination of the zinc bath, expressed in weight per cent of lead (Pb) in the zinc, has been measured for two different situations during 6 months:

a: only a bed of anthracite coal covered the exit of the lead bath;

b: the bed of anthracite coal was mixed with the double salt $ZnCl_2 . NH_4Cl$ in a weight ratio 1 part of double salt per 10 parts of anthracite coal ; this mixture was renewed after each week.

Figure 3:
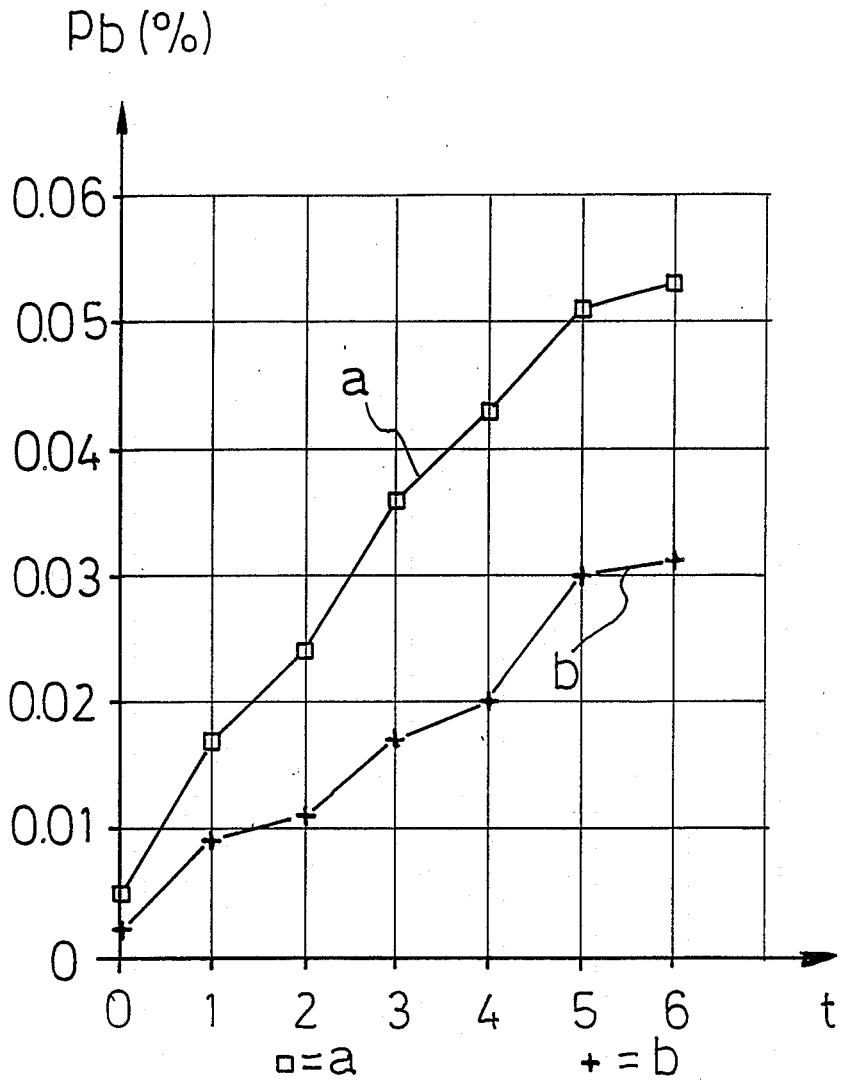
FIG. 3 illustrates a decrease in poisoning of a subsequent zinc bath due to application of the present invention.

FIG. 3 shows the results of test 2. It is clear that application of the teaching of the present invention substantially decreases the poisoning of the zinc bath.

I claim:

1. A process of heat treatment of at least one elongated steel element consisting essentially of:

conducting said elongated steel element through a bath of molten lead, and immediately upon exit from said bath of molten lead, contacting said elongated steel element with an amount of a substance that is capable of transforming lead oxide to lead or a lead compound sufficient to reduce lead entrainment on said elongated steel element at the exit conditions of said elongated steel element from said bath of molten lead.

2. A process according to claim 1 wherein said substance is a sulfide.

3. A process according to claim 1 wherein said substance is a fluoride.

4. A process according to claim 1 wherein said substance is a chloride.

5. A process according to claim 4 wherein said substance is HCl.

6. A process according to claim 4 wherein said substance is $NH_4Cl$.

7. A process according to claim 1 wherein said substance is $ZnCl_2 . n NH_4Cl$, n being an integer greater than or equal to one and smaller than or equal to three.

8. A process according to any one of claims 1 to 7 wherein said elongated steel element emerges from said bath of molten lead in a non-oxidizing atmosphere.

9. A process according to any one of claims 1 to 7 further comprising, after transformation of lead oxide to another product, mechanically stripping the lead from said elongated steel element.

10. A process according to claim 8 wherein the exit of said bath of molten lead is covered with a bed of coal.

11. A process according to claim 9, wherein the exit of said bath of molten lead is covered with a bed of coal.

* * * * *